US009393821B2

(12) United States Patent
Okuda

(10) Patent No.: US 9,393,821 B2
(45) Date of Patent: Jul. 19, 2016

(54) PRINTER AND CONTROL METHOD FOR A PRINTER

(71) Applicant: Seiko Epson Corporation, Tokyo (JP)

(72) Inventor: Yasumichi Okuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/590,200

(22) Filed: Jan. 6, 2015

(65) Prior Publication Data

US 2015/0202904 A1 Jul. 23, 2015

(30) Foreign Application Priority Data

Jan. 17, 2014 (JP) ..... 2014-006461

(51) Int. Cl.

| | |
|---|---|
| ***B41J 25/304*** | (2006.01) |
| ***B41J 2/155*** | (2006.01) |
| ***B41J 25/308*** | (2006.01) |
| ***B41J 29/393*** | (2006.01) |

(52) U.S. Cl.

CPC ..... *B41J 25/3086* (2013.01); *B41J 2/155* (2013.01); *B41J 25/304* (2013.01); *B41J 25/3082* (2013.01); *B41J 29/393* (2013.01)

(58) Field of Classification Search

CPC ..... B41J 2/16588; B41J 2/16585

See application file for complete search history.

(56) References Cited

U.S. PATENT DOCUMENTS

| | | | | |
|---|---|---|---|---|
| 4,577,203 | A * | 3/1986 | Kawamura | 347/30 |
| 2003/0043228 | A1* | 3/2003 | Igarashi | B41J 19/202 347/37 |
| 2004/0252161 | A1* | 12/2004 | Bibl | B41J 2/16588 347/42 |
| 2009/0284556 | A1* | 11/2009 | Okazawa | B41J 25/308 347/8 |
| 2009/0284566 | A1* | 11/2009 | Suzuki et al. | 347/38 |
| 2015/0116424 | A1* | 4/2015 | Nagata et al. | 347/37 |

FOREIGN PATENT DOCUMENTS

| | | |
|---|---|---|
| JP | 08-156362 A | 6/1996 |
| JP | 2013-056464 A | 3/2013 |

* cited by examiner

*Primary Examiner* — Shelby Fidler

(57) ABSTRACT

A carriage 11 carrying a printhead 7 moves on a transverse axis X by a carriage moving mechanism 15, and is detected by a first sensor 18 at a standby position 11B at one end of the range of movement. When the carriage 11 is at the opposing position 11A, the printhead 7 and head frame 12 are moved vertically by the head moving mechanism 17, and are detected at the up position 12A by the second sensor 19. When the position of the printhead 7 and carriage 11 are unknown, the control unit 1*a* of the printer 1 executes a recovery process that moves the carriage 11 to the opposing position 11A side, detects when the carriage 11 becomes locked at the opposing position 11A, and determines the position of the carriage 11.

15 Claims, 12 Drawing Sheets

PRINTER AND CONTROL METHOD FOR A PRINTER

CROSS REFERENCE TO RELATED APPLICATION(S)

This application claims priority under 35 U.S.C. §119 to Japanese Application No. 2014-006461, filed Jan. 17, 2014, the content of which is hereby incorporated by reference in its entirety.

BACKGROUND

1. Technical Field

The present disclosure relates to a printer having a mechanism for mounting and moving a printhead on a carriage, and to a method of controlling the printer.

2. Related Art

Printers that convey sheet media over a platen surface, dispose the printhead mounted on a carriage above the platen surface, and have a carriage moving mechanism that moves the carriage carrying the printhead bidirectionally across the paper width (in the transverse direction) perpendicularly to the media conveyance direction are known from the literature. See, for example, JP-A-H08-156362. The printer taught in JP-A-H08-156362 has a home position detect ion sensor disposed within the range of carriage movement, detects the carriage at the home position by this sensor, and counts the number of steps a stepper motor is driven from this position to control the position of the carriage.

Some inkjet printers have a lift mechanism that raises and lowers the carriage carrying the printhead to hold the gap between the platen and the printhead to a constant distance. This configuration requires a mechanism that moves the carriage in two directions, across the paper width (horizontally) and up and down (vertically). When a large printhead such as a line inkjet head is used, the head unit including the printhead mounted on the carriage becomes accordingly large. As a result, precisely controlling the position when moving this head unit vertically and horizontally is difficult, the paper or other member may contact the printhead and become soiled with ink, and the printhead can be potentially damaged. Furthermore, if movement of the carriage or printhead stops because of some problem, recovery is difficult if the position where the carriage or printhead stopped is unknown, and the carriage or printhead may be moved in the wrong direction.

To precisely control the position of a head unit comprising a printhead mounted on a carriage, a detection mechanism that accurately detects the position of the carriage is desirable. For example, if an encoder or other sensor is mounted on the carriage, the position of the carriage can be detected throughout the full range of carriage movement. However, when the carriage moves in two directions, vertically and horizontally, two sets of encoders or other sensors must be disposed to the head unit, construction becomes complicated, the parts count rises, and the cost increases. Furthermore, because the number of parts mounted on the head unit increases and the head unit becomes even larger, moving the head unit at high speed becomes difficult and throughput drops.

SUMMARY

The present disclosure provides a construction that avoids increasing the size and complicating the configuration of a head unit carrying a printhead, and enables desirably executing a recovery process when the position of the printhead becomes unknown due to some problem, in a printer that moves and controls the position of a printhead in two directions.

One aspect of the invention is a printer including: a printhead and a platen; a carriage that supports the printhead movably in the direction increasing or decreasing the gap between the printhead and the platen; a carriage moving mechanism that moves the carriage to an opposing position where the printhead is opposite the platen, and a standby position where the printhead is not opposite the platen; a head moving mechanism that moves the printhead between a first head position where the gap between the printhead and platen is a first distance, and a second head position where said gap is a second distance that is shorter than the first distance, when the carriage is at the opposing position; and a sensor that detects the printhead and is disposed to a position where the direction of movement changes between movement of the printhead by the head moving mechanism and movement of the carriage by the carriage moving mechanism.

Preferably, the printer also has a first sensor disposed to a first detection position in the movement range of the carriage moving mechanism to detect the carriage; and a second sensor disposed to a second detection position in the movement range of the head moving mechanism to detect the printhead; and the second sensor detects the printhead at the second detection position.

A printer according to this aspect of the invention thus has a mechanism that moves the printhead in two directions (the direction changing the gap between the printhead and the platen, and the direction of movement between the position opposite the platen and the position not opposite the platen), and has first and second sensors disposed in these two directions to detect the printhead or the carriage at reference detection positions. By thus disposing a sensor in each direction of movement, the current position can be determined based on the amount of movement from the detection position. Therefore, when moving and controlling the position of the printhead in two directions, there is no need to provide an encoder or other sensor on the head unit to detect the position of the printhead throughout the full range of movement. Increasing the size and complicating the construction of the head unit can therefore be avoided, and increased cost can be avoided.

In the invention, the detection position of the second sensor is set to the position of change between movement of the printhead by the head moving mechanism and movement of the carriage by the carriage moving mechanism.

When thus comprised, the printhead or the carriage can always be detected at the position where the direction of movement changes. Therefore, while using a simple sensor, an inappropriate recovery operation based on the sensor output signals can be prevented when the positions of the printhead and the carriage are unclear (unknown) due to an error. More specifically, because the printhead moves in this embodiment when the carriage is at the opposing position, operation of the head moving mechanism can be determined to be inappropriate when the printhead or the carriage is not detected. Furthermore, when the printhead is not detected, damage to the printhead or soiling with ink may occur depending on the direction the carriage moves. Therefore, by moving the carriage in the appropriate direction, the printhead can be recovered from the unknown state without damage to the printhead or soiling with ink.

A printer according to another aspect of the invention preferably also has a control unit that controls movement of the printhead and the carriage based on the signal of the first sensor and the signal of the second sensor. The first detection position is the standby position; the second detection position is the first head position; and when the printhead is at the second detection position and the carriage is at the opposing position, the control unit changes the movement of the carriage by the carriage moving mechanism and the movement of the printhead by the head moving mechanism.

Thus comprised, damage to the printhead and soiling media or other parts by ink can be avoided because the carriage that carries the printhead moves when the platen gap is large (when the printhead is at the first head position). When moving the carriage to the opposing position, whether or not the opposing position is reached can be determined based on the signal from the second sensor. Therefore, problems with the carriage moving mechanism or the head moving mechanism can be detected based on how much the carriage moving mechanism or head moving mechanism is driven and the signals from the first and second sensors. In addition, when the position of the printhead and carriage becomes unclear (unknown) due to some problem, executing an inappropriate recovery operation based on the signals from the first and second sensors can be avoided.

In another aspect of the invention, the first sensor is an optical sensor. In another aspect of the invention, the second sensor is a mechanical sensor.

Because the sensors in this aspect of the invention are small and simple, the size of the head unit does not increase. Problems resulting from using a large head unit can also be avoided. Installation in limited space is therefore simple, and cost is low.

Further preferably, the carriage moving mechanism includes a carriage motor and a first encoder that detects rotation of the carriage motor. Further preferably, the head moving mechanism includes a head moving motor and a second encoder that detects rotation of the head moving motor.

By using a motor and an encoder in the moving mechanisms, the printhead or carriage becoming locked (a state in which the printhead or carriage does not move even though the motor is driving) can be detected. More specifically, a locked state can be detected by detecting a loss of synchronization between the signals that drive the motors and the signals from the encoders. This locked state occurs when the printhead or the carriage reaches a position jammed against another member in the printer. The current position of the printhead or carriage can therefore be determined by detecting this locked state, and the unknown state can be resolved.

A printer according to another aspect of the invention, when the first sensor detects the carriage and is in a carriage-detected state and the carriage moving mechanism is then driven in the direction moving the carriage toward the opposing position, the control unit determines an error occurred if the carriage moving mechanism is driven at least a preset first drive distance but the printhead is not detected by the second sensor.

Thus comprised, by disposing a sensor to the position where the direction of movement changes, problems can be detected based on a loss of synchronization between how much the carriage moving mechanism drives and the signals from the first and second sensors.

In a printer according to another aspect of the invention, when the second sensor detects the printhead and is in a printhead-detected state and the head moving mechanism is then driven in the direction moving the printhead toward the second head position, the control unit determines an error occurred if the head moving mechanism is driven at least a preset second drive distance but the second sensor does not change to a not-detected state.

Thus comprised, errors can be detected based on a loss of synchronization between how much the head moving mechanism drives and the signal from the second sensor.

In a printer according to another aspect of the invention, when the first sensor is in the not-detected state not detecting the carriage, and the second sensor is in the not-detected state not detecting the printhead, the control unit executes a recovery process moving the carriage to the opposing position and determining the position of the carriage.

If operation stops due to an error when both sensors are in the not-detected state, the amount of movement from the reference position is unknown, and the position of the carriage and printhead cannot be determined (are unknown). To recover from this unknown condition, the carriage is moved to attempt to determine its position, and damage to the printhead resulting from moving the carriage to the standby position side where the platen gap is small can be avoided by setting the direction of movement toward the opposing position side. The unknown state can therefore be resolved without performing an inappropriate operation.

A printer according to another aspect of the invention preferably also has a position limiting member that limits movement of the carriage at the opposing position; and the control unit detects a locked state of the carriage due to contact with the position limiting member, and determines the position of the carriage, in the recovery process.

The carriage being locked can be detected by detecting a loss of synchronization of the carriage motor. The position of the carriage can therefore be determined and the unknown state resolved without providing a separate sensor to detect the carriage.

Another aspect of the invention is a control method of a printer having a printhead and a platen, a carriage that supports the printhead, a carriage moving mechanism that moves the carriage, a head moving mechanism that moves the printhead in the gap between the printhead and platen, a sensor that detects the position of the printhead, and a control unit that controls the position of the printhead and the carriage based on a signal from the sensor, the control method including: the sensor being disposed to the position of change between movement of the printhead by the head moving mechanism and movement of the carriage by the carriage moving mechanism; and the control unit detecting the printhead based on a signal of the sensor.

Preferably, the control unit moves the carriage between an opposing position where the printhead is opposite the platen, and a standby position where the printhead is not opposite the platen, and controls movement of the carriage based on a signal of the first sensor that detects the carriage at the standby position; moves the printhead between a first head position where the gap between the printhead and platen is a first distance, and a second head position where said gap is a second distance that is shorter than the first distance, when the carriage is at the opposing position; and controls movement of the printhead based on a signal of the second sensor that detects the printhead at the first head position; and executes a recovery process of moving the carriage to the opposing position and determining the position of the carriage when the first sensor is in the not-detected state not detecting the carriage and the second sensor is in the not-detected state not detecting the printhead.

Further preferably in a control method of a printer according to another aspect of the invention, the control unit detects a locked state of the carriage due to contact with a position limiting member that limits movement of the carriage at the opposing position, and determines the position of the carriage, in the recovery process.

Effect of the Invention

When moving and controlling the position of the printhead in two directions, there is no need to provide an encoder or other sensor capable of detecting the position of the printhead throughout the full range of movement on the head unit. Increasing the size of the head unit and the cost can therefore be avoided. Furthermore, because the printhead or carriage can always be detected at the position of change between movement of the printhead and movement of the carriage, executing an inappropriate recovery process based on sensor signals when the position of the printhead and carriage is unclear (unknown) due to some problem can be prevented while using a configuration comprising a simple sensor that detects at only one location.

More specifically, because the printhead moves when the carriage is at the opposing position, operation of the head moving mechanism can be determined to be inappropriate when the printhead or the carriage is not detected. Furthermore, when the printhead is not detected, damage to the printhead or soiling with ink may occur depending on the direction the carriage moves. However, by driving the carriage in the appropriate direction, the printhead can be recovered from the unknown state without damage to the printhead or soiling with ink.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a printer and a control method therefor according to the present invention are described below with reference to the accompanying figures.

General Configuration

Figure 1:
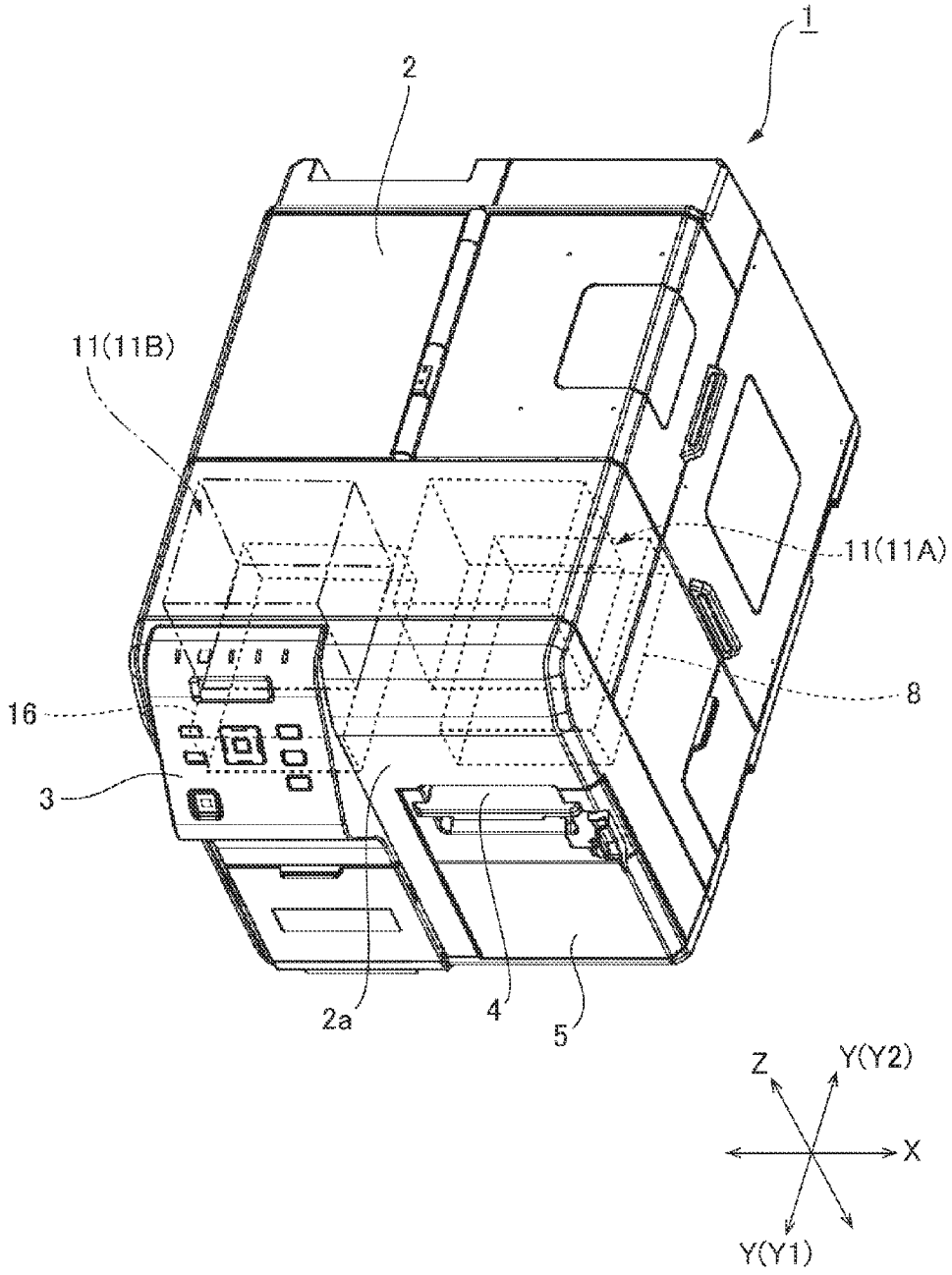
FIG. 1 is an external oblique view of a printer according to an embodiment of the invention.
Figure 2:
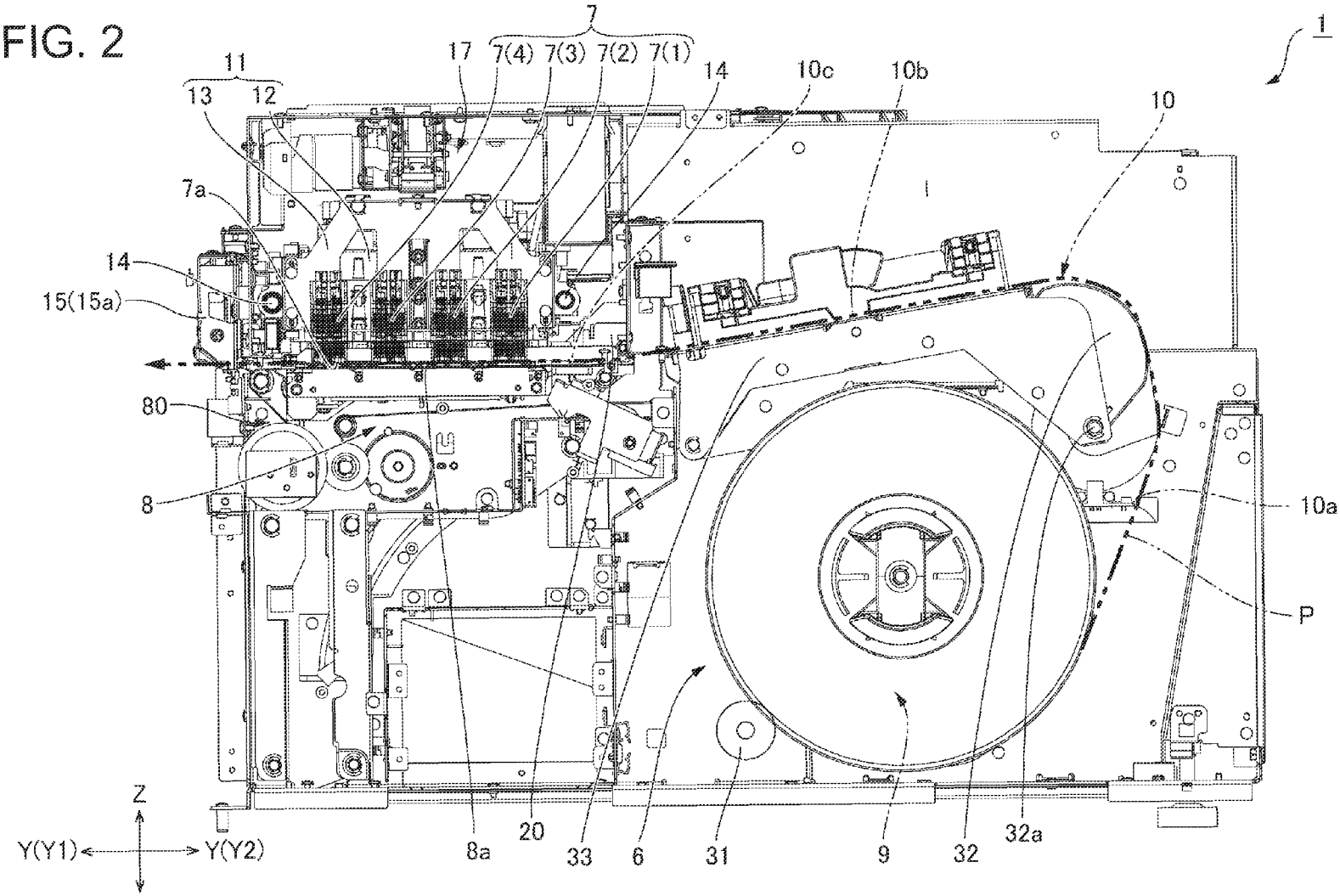
FIG. 2 is a vertical section view showing the internal configuration of the printer in FIG. 1.

FIG. 1 is an external oblique view of a printer according to the invention. FIG. 2 is a vertical section view showing the internal configuration of the printer.

As shown in FIG. 1, the printer 1 has a printer cabinet 2 that is basically box-shaped and is long from front to back. An operating panel 3 is disposed at the top of the front 2*a* of the printer cabinet 2 on one side of the width, and a paper exit 4 is formed on the other side. An access cover 5 for maintenance is disposed below the paper exit 4.

As shown in FIG. 1, the invention is described below with reference to the three mutually perpendicular directional axes X, Y, and Z, the transverse axis X across the device width, the longitudinal axis Y between the front and back of the device, and a vertical axis Z. Note also that Y1 denotes the front of the printer, and Y2 denotes the back of the printer.

As shown in FIG. 2, a roll paper compartment 6 is formed at the bottom at the back Y2 inside the printer cabinet 2. A printhead 7 is disposed at the top of the printer front Y1, and a platen unit 8 is disposed below the printhead 7 at the front Y1. The printhead 7 is disposed with the nozzle face 7*a* facing down. The platen unit 8 has a horizontal platen surface 8*a* opposite the nozzle face 7*a* of the printhead 7 with a specific platen gap G (see FIGS. 10 (*b*) and (*c*)) therebetween.

The printhead 7 is a line inkjet head, and as shown in FIG. 2 includes four heads, a first head 7(1), second head 7(2), third head 7(3), and fourth head 7(4). These four heads are narrow and long on the transverse axis X, and are disposed at a regular interval on the longitudinal axis Y. Rows of ink nozzles that eject ink droplets are formed in the nozzle face of each head, and each row is longer than the maximum width of the recording paper P that can be used. The printhead 7 is mounted on a carriage 11.

The carriage 11 has a head frame 12 that supports the printhead 7, and a carriage frame 13 that supports the head frame 12 movably on the vertical axis Z. The printhead 7 and carriage 11 embody a head unit that is moved on the transverse axis X by a carriage moving mechanism 15 described below. The head frame 12 supporting the printhead 7 is also moved together the printhead 7 on the vertical axis Z by a head moving mechanism 17 (head moving mechanism) described below.

As shown in FIG. 2, a platen top unit 20 is disposed between the printhead 7 and carriage 11 and the platen unit 8. The platen top unit 20 is separated from the platen unit 8, and fastened to the main frame of the printer 1. The platen top unit 20 holds three ball bearings 21 (see FIG. 10) at positions where the head frame 12 and platen unit 8 overlap on the vertical axis Z. As described below, the three bearings 21 are held between the head frame 12 and the platen unit 8, and are members that hold a preset second distance L2 between the nozzle face 7*a* of the printhead 7 and the platen surface 8*a* (the platen gap G, FIG. 10).

Inside the printer cabinet 2, the continuous recording paper P pulled from the paper roll 9 in the roll paper compartment 6 is conveyed through the conveyance path 10 indicated by the imaginary line past the print position of the printhead 7 toward the paper exit 4 opened in the front 2*a* of the printer cabinet 2, and is discharged from the paper exit 4.

The paper conveyance path 10 includes a first conveyance path section 10*a* that extends diagonally upward toward the back Y2 from the roll paper compartment 6; a second conveyance path section 10*b* that curves from the top end of the first conveyance path section 10*a* toward the front Y1 and descends gradually to the platen surface 8*a*; and a third conveyance path section 10*c* that extends horizontally from the back Y2 end of the platen surface 8*a* to the front Y1 of the printer. The print position of the printhead 7 is disposed in the middle of the third conveyance path section 10*c*.

A roll spindle 31 on which the paper roll 9 is installed is disposed in the roll paper compartment 6. The roll spindle 31 extends on the transverse axis X, and is driven rotationally by drive power from a media supply motor 31*a* disposed near the bottom of the printer cabinet 2. The paper roll 9 is installed so that it cannot rotate relative to the roll spindle 31, and when the roll spindle 31 turns, the recording paper P is delivered from the paper roll 9 to the first conveyance path section 10*a* of the conveyance path 10.

A tension lever 32 that applies back tension to the recording paper P is disposed where the conveyance path 10 curves and changes direction from the first conveyance path section 10*a* to the second conveyance path section 10*b*. The distal end of the tension lever 32 has a curved outside surface, and the recording paper P is mounted thereon. The tension lever 32 is attached pivotably around a predetermined axis of rotation 32*a*, and is urged by a spring member (not shown in the figure) to the back Y2.

A paper guide 33 is disposed on the front Y1 side of the tension lever 32, and the second conveyance path section 10*b* of the conveyance path 10 is defined by the paper guide 33. The paper guide 33 is shaped to descend gently to the front Y1, and guides the recording paper P from the tension lever 32 toward the platen surface 8*a*.

Figure 3:
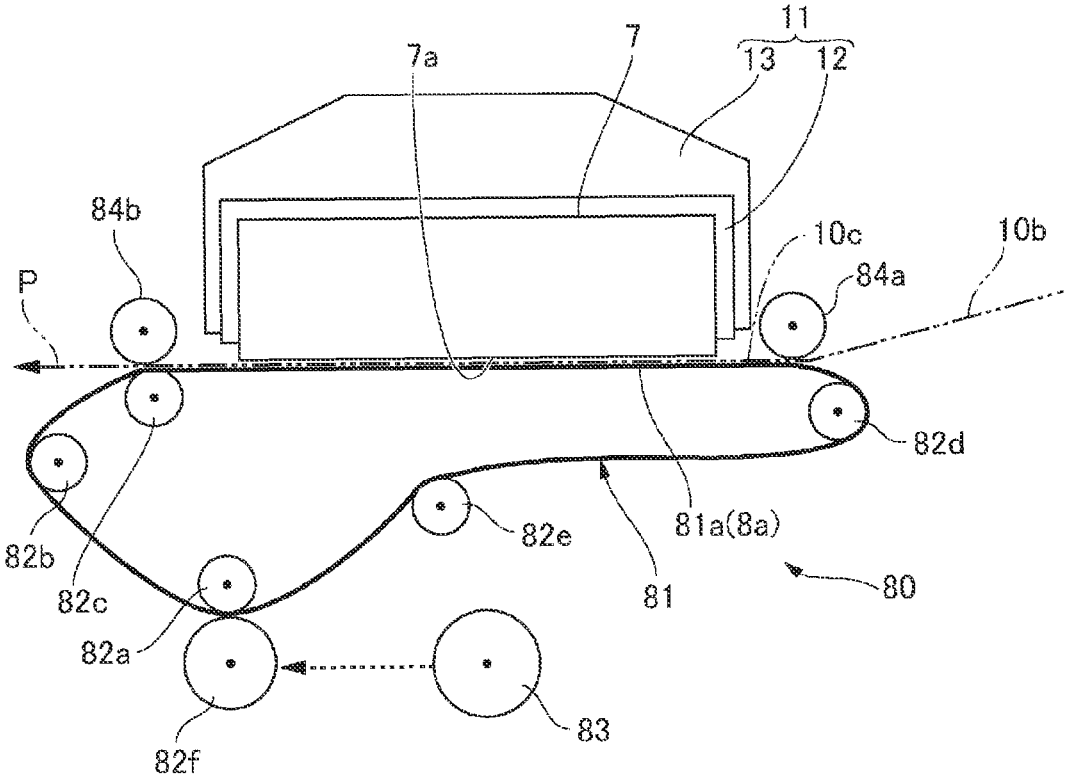
FIG. 3 schematically illustrates the media conveyance mechanism.

A belt conveyor mechanism 80 is mounted on the platen unit 8. FIG. 3 schematically illustrates the belt conveyor mechanism 80. The belt conveyor mechanism 80 includes an endless conveyor belt 81 disposed below the third conveyance path section 10*c*; plural guide rollers 82*b* to 82*e* on which the conveyor belt 81 is mounted; a drive roller 82*f* that drives the conveyor belt 81; and a conveyor motor 83 that causes the belt drive roller 82*f* to turn. The conveyor belt 81 is pressed against the belt drive roller 82*f* by the guide roller 82*a*. By driving the belt drive roller 82*f*, the conveyor belt 81 moves through the path passing the guide rollers 82*a* to 82*e*.

The portion of the conveyor belt 81 between guide rollers 82*c* and 82*d* is the horizontal belt portion 81*a* extending horizontally over the third conveyance path section 10*c*. The upstream end and the downstream end of the horizontal belt portion 81*a* in the conveyance direction (that is, the longitudinal axis Y) are pressed from above the platen unit 8 by the pinch rollers 84*a*, 84*b*. The belt conveyor mechanism 80 conveys the recording paper P between the pinch rollers 84*a*, 84*b* and the horizontal belt portion 81*a*.

Carriage Moving Mechanism

A pair of parallel carriage guide rails 14 are disposed extending on the transverse axis X in front and back of the carriage 11 on the longitudinal axis Y. The carriage 11 is supported movably on the transverse axis X by this pair of carriage guide rails 14. A carriage moving mechanism 15 is disposed on the front Y1 side of the carriage 11.

The carriage moving mechanism 15 has a pair of timing pulleys (not shown in the figure), a timing belt (not shown in the figure), a carriage motor 15*a*, and an encoder 15*b* (see FIG. 9) that detects rotation of the carriage motor 15*a*. The pair of timing pulleys are disposed near the opposite ends of the carriage guide rails 14. The timing belt is mounted on the pair of timing pulleys, and the timing belt is fastened at one place to the carriage 11. When the carriage motor 15*a* is driven, the pair of timing pulleys turn and the timing belt moves. As a result, the carriage 11 moves bidirectionally on the transverse axis X along the pair of carriage guide rails 14.

The carriage 11 moves between the opposing position 11A indicated by the dotted line in FIG. 1, and the standby position 11B indicated by the double-dotted line in FIG. 1.

When the carriage 11 is at the opposing position 11A, the printhead 7 mounted on the carriage 11 is opposite the platen unit 8. When the carriage 11 is at the standby position 11B, the printhead 7 mounted on the carriage 11 is not opposite the platen unit 8. A head maintenance unit 16 is disposed below the standby position 11B. When the carriage 11 moves to the standby position 11B, the printhead 7 is opposite the head maintenance unit 16.

First Sensor

Figure 4A:
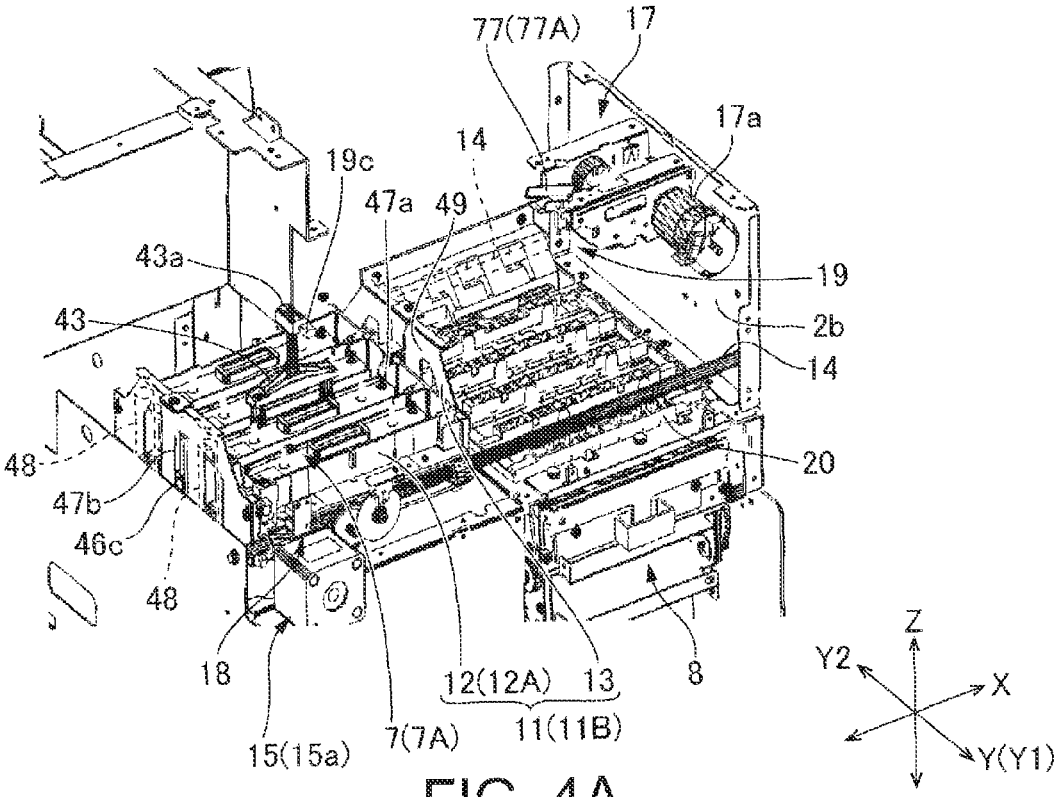
FIG. 4 is an oblique view showing part of the internal mechanism of the printer.
Figure 4B:
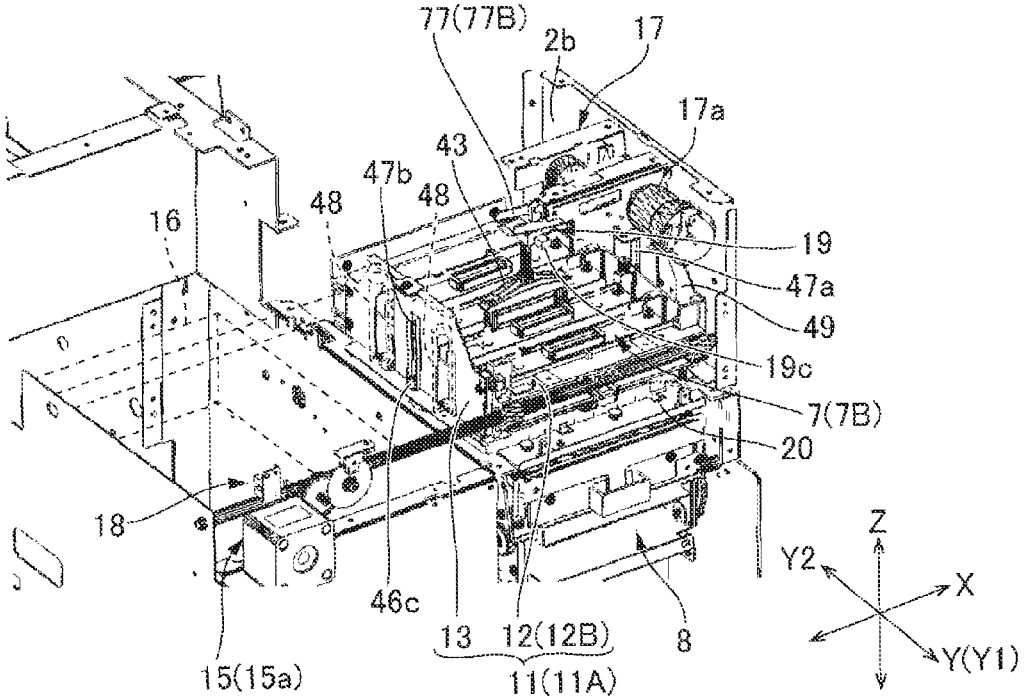
Figure 5A:
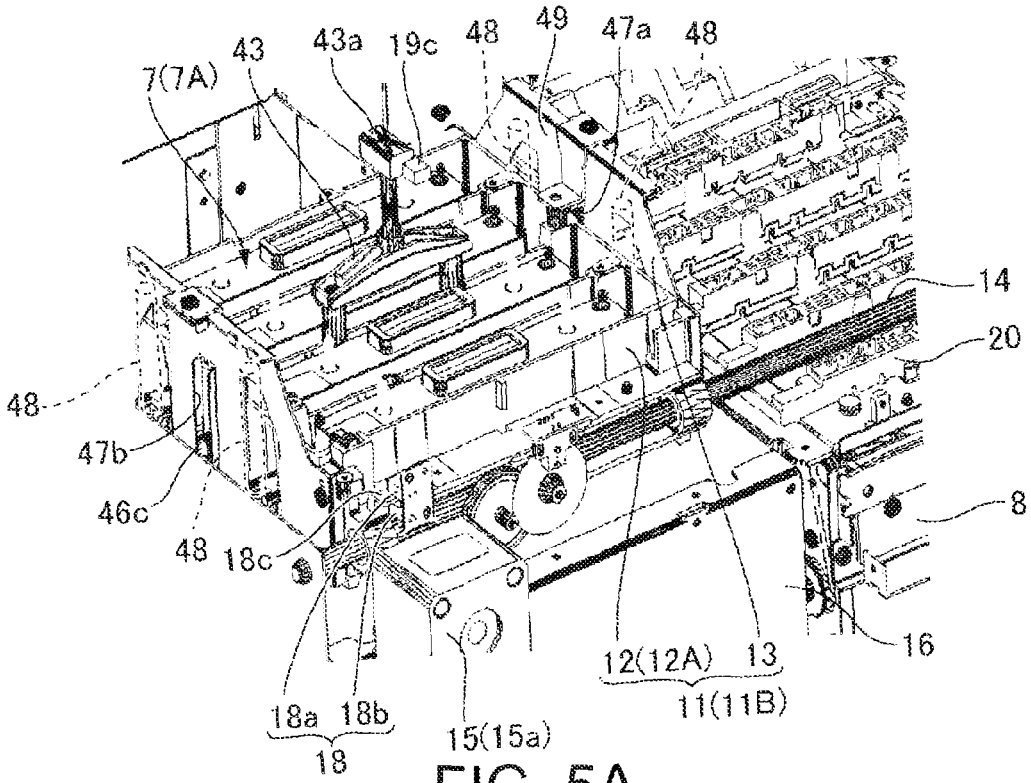
FIG. 5 illustrates a first sensor for detecting the carriage.
Figure 5B:
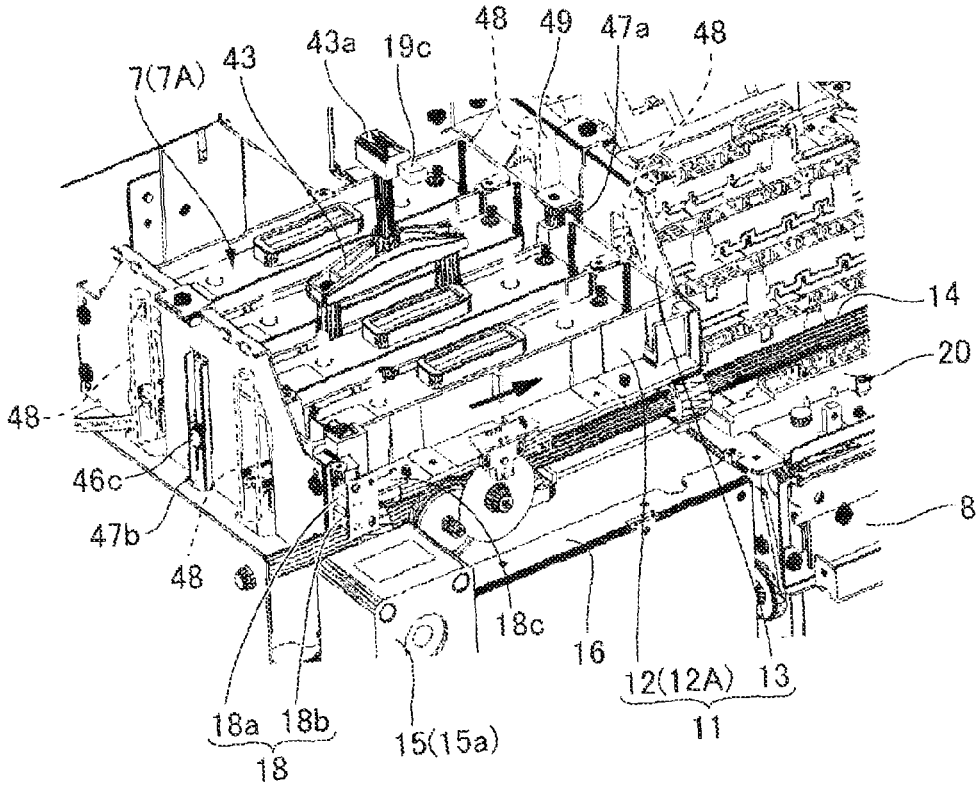

FIG. 4 is an oblique view illustrating part of the internal configuration of the printer 1, FIG. 4 (*a*) showing the carriage 11 at the standby position 11B, and FIG. 4 (*b*) showing the carriage 11 at the opposing position 11A. FIG. 5 illustrates the first sensor that detects the carriage 11, FIG. 5 (*a*) showing when the carriage 11 is detected, and FIG. 5 (*b*) showing when the carriage 11 is not detected. As shown in FIG. 4 and FIG. 5, a first sensor 18 that detects the carriage 11 in the standby position 11B (first detection position) is disposed near the end of the carriage guide rails 14 at the front Y1. This first sensor 18 is an optical sensor, and includes an emitter 18*a* and a receptor 18*b* facing each other on the vertical axis Z. The carriage 11 has a flat interrupter 18*c* projecting at the front Y1 from the side of the carriage frame 13.

As shown in FIG. 5 (*a*), when the carriage 11 is at the standby position 11B, the interrupter 18*c* intervenes between the emitter 18*a* and receptor 18*b* and breaks the detection beam. When the carriage 11 moves from the standby position 11B toward the opposing position 11A, the interrupter 18*c* leaves the gap between the emitter 18*a* and receptor 18*b* as shown in FIG. 5 (*b*). The first sensor 18 detects the carriage 11 at the standby position 11B by this mechanism.

Carriage Construction

Figure 6A:
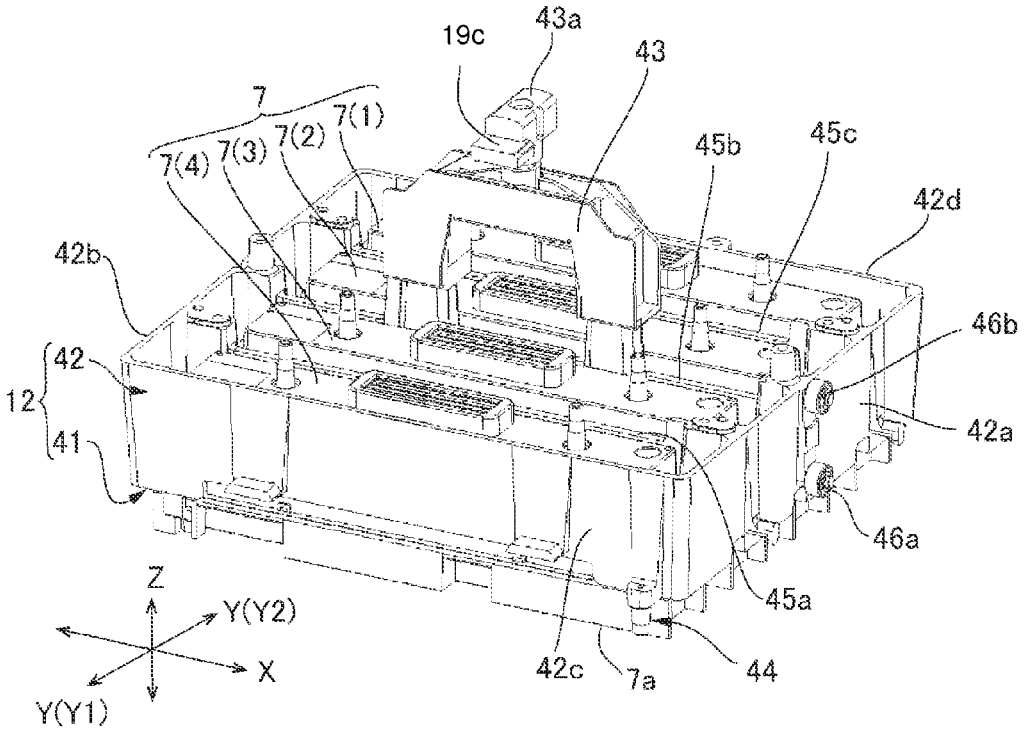
FIG. 6 is an oblique view of the head frame and the printhead removed from the carriage frame.
Figure 6B:
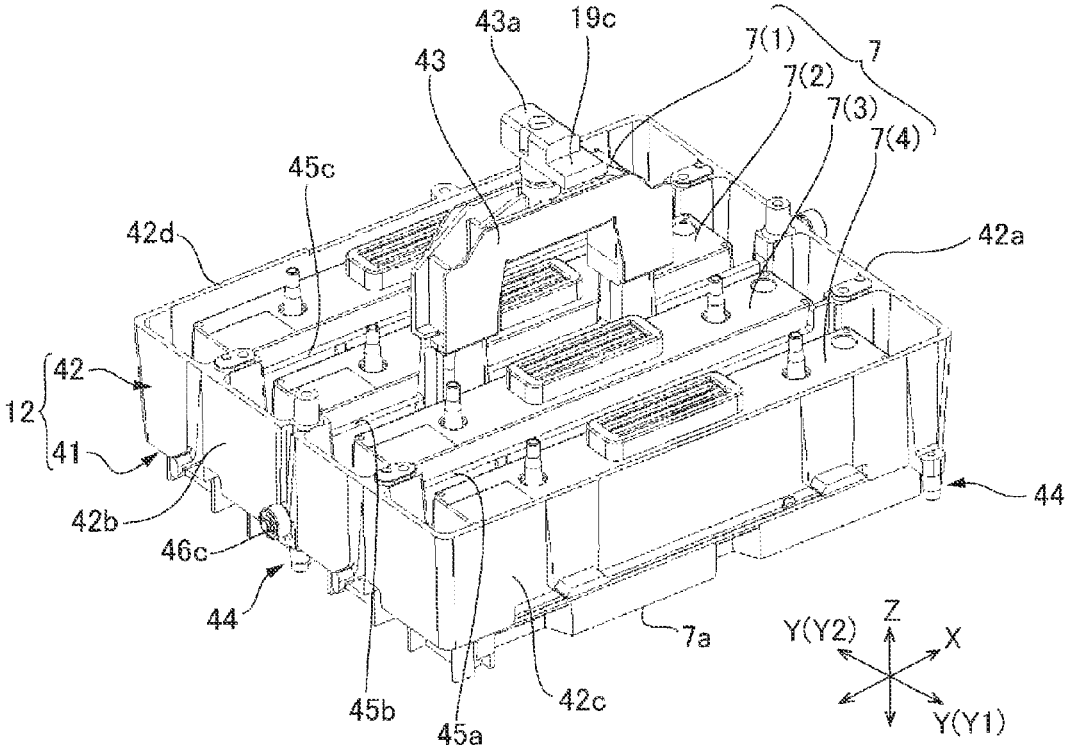

FIG. 6 is an oblique view of the head frame 12 and printhead 7 removed from the carriage frame 13, FIGS. 6 (*a*) and (*b*) respectively being oblique views from one side and the other side on the transverse axis X. As described above, the head frame 12 that supports the printhead 7 is supported movably on the vertical axis Z by the carriage frame 13.

As shown in FIGS. 6 (*a*) and (*b*), the head frame 12 includes a rectangular bottom 41, a side wall unit 42 that rises vertically from the outside edges of the bottom 41, and an operating unit 43 that protrudes from the center part of the bottom. 41 to a height above the top of the side wall unit 42.

The four line heads (first head 7(1) to fourth head 7(4)) of the printhead 7 are inserted from above to the side wall unit 42, and are held in the head frame 12 with the bottom parts of the heads protruding down from openings formed in the bottom 41. Head stops 44 are formed to the bottom 41 at positions that can contact the three bearings 21 held by the platen top unit 20.

The side wall unit 42 has a first wall section 42*a* and a second wall section 42*b* extending on the longitudinal axis Y, and a third wall section 42*c* and a fourth wall section 42*d* that extend on the transverse axis X.

Three reinforcing panels 45*a* to 45*c* that connect the first wall section 42*a* and the second wall section 42*b* are disposed between the four line heads (first head 7(1) to fourth head 7(4)) arranged on the longitudinal axis Y inside the side wall unit 42. Of the three reinforcing panels 45*a* to 45*c*, the reinforcing panel 45*b* in the center on the longitudinal axis Y is formed integrally with the operating unit 43. A stop 43*a* that contacts the operating lever 77 (see FIG. 7) of the head moving mechanism 17 is disposed to the top part of the operating unit 43, and a pressure portion 19*c* is formed protruding to the front Y1 from the stop 43*a*. When the head frame 12 moves up or down, the signal from the second sensor 19 described below is changed by the pressure portion 19*c*.

As shown in FIG. 6 (*a*), a first bottom guide roller 46*a* and a first top guide roller 46*b* are disposed to the first wall section 42*a* in the center on the longitudinal axis Y and separated from each other on the vertical axis Z. As shown in FIG. 6 (*b*), a second guide roller 46*c* is disposed to the second wall section 42*b* at the middle on the longitudinal axis Y. The second guide roller 46*c* is disposed coaxially to the first bottom guide roller 46*a*.

As shown in FIGS. 5 (*a*) and (*b*), the carriage frame 13 is shaped like a picture frame, and supports the head frame 12 inside the carriage frame 13.

A first guide channel 47*a* is formed on the vertical axis Z in the outside of the first wall section 42*a* of the head frame 12. A second guide channel 47*b* extending on the vertical axis Z is formed in the second wall section 42*b* of the head frame 12. When the head frame 12 is placed inside the carriage frame 13, the first bottom guide roller 46*a* and first top guide roller 46*b* are inserted to the first guide channel 47*a*, and the second guide roller 46*c* is inserted to the second guide channel 47*b*. As a result, the head frame 12 is supported by the carriage frame 13 movably between an up position 12A (see FIGS. 10 (*a*) and (*b*)) where the first top guide roller 46*b* is in the top part of the first guide channel 47*a*, and a down position 12B (see FIG. 10 (*c*)) where the first bottom guide roller 46*a* is in the bottom part of the first guide channel 47*a*. The printhead 7 is at the first head position 7A (see FIGS. 10 (*a*) and (*b*)) when the head frame 12 is at the up position 12A, and is at a second head position 7B (see FIG. 10 (*c*)) when the head frame 12 is at the down position 12B.

Four coil springs 48 are disposed between the head frame 12 and the carriage frame 13. The head frame 12 is urged to the up position 12A by the urging force of the four coil springs 48.

Head Moving Mechanism

Figure 7:
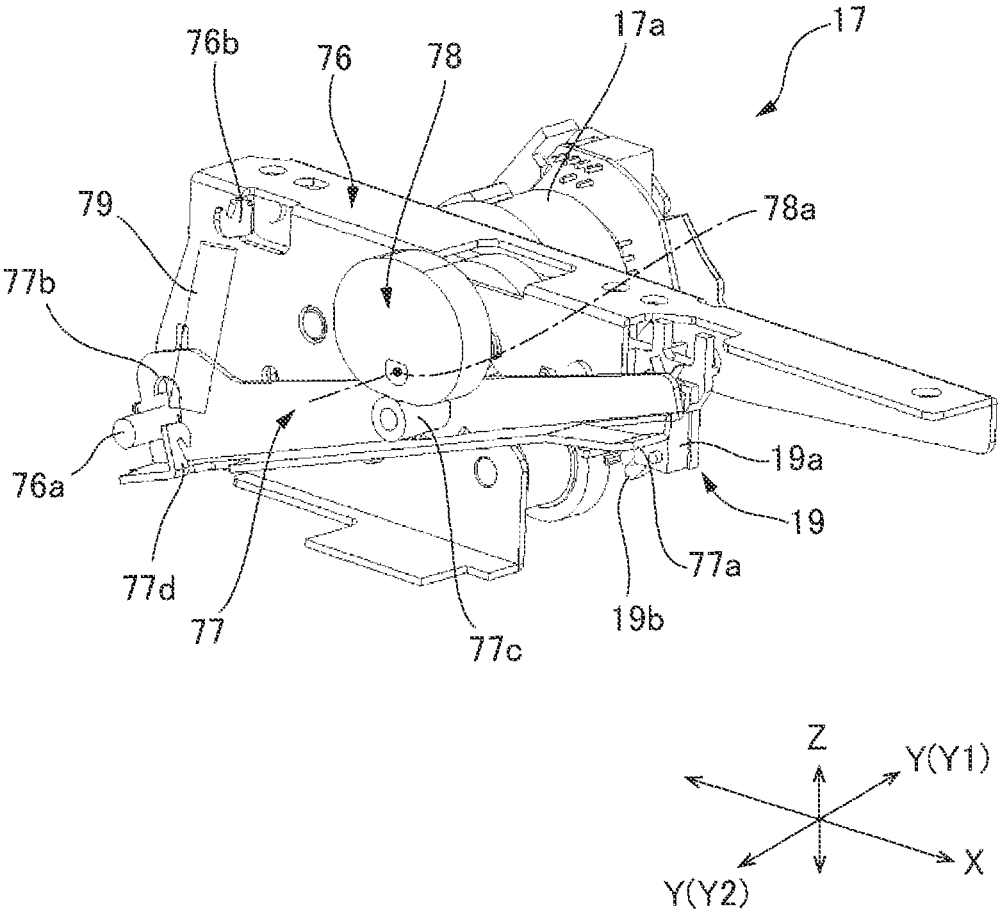
FIG. 7 is an oblique view of the head moving mechanism.

FIG. 7 is an oblique view of the head moving mechanism 17.

The head moving mechanism 17 includes a frame 76 with a support pin 76*a* extending to the printer back Y2; an operating lever 77 extending on the transverse axis X; an eccentric cam 78 disposed above the support pin 76*a* and the operating lever 77; a cam drive motor 17*a* (head moving motor) as the drive source of the eccentric cam 78; an encoder 17*b* (see FIG. 9) that detects rotation of the cam drive motor 17*a*; and a coil spring 79.

The operating lever 77 has an operating part 77*a* at on end on the transverse axis X that can contact the operating unit 43 of the head frame 12, and an oval hole 77*b* at the other end. The support pin 76*a* is inserted to the oval hole 77*b*.

A cam follower 77*c* that contacts the cam surface (outside surface) of the eccentric cam 78 is disposed between the operating part 77*a* and the oval hole 77*b* of the operating lever 77. The bottom end of the coil spring 79 is held at a position near the oval hole 77*b* between the cam follower 77*c* and the oval hole 77*b*. The top end of the coil spring 79 is held by the top edge of the frame 76. The coil spring 79 urges the operating lever 77 up.

When the cam drive motor 17*a* is driven, the eccentric cam 78 turns, and the cam follower 77*c* moves vertically. As a result, the operating lever 77 moves between the lever-up position 77A where the operating part 77*a* is positioned above the axis of rotation 78*a* of the eccentric cam 78 (see FIGS. 10 (*a*) and (*b*)), and the lever-down position 77B where the operating part 77*a* is lower than the axis of rotation 78*a* of the eccentric cam 78 (FIG. 10 (*c*)).

When the carriage 11 is set to the opposing position 11A, the operating part 77*a* of the operating lever 77 extends to a position vertically above the stop 43*a* of the head frame 12. When the operating lever 77 moves from this position toward the lever-down position 77B, the head frame 12 is pushed down against the urging force of the coil spring 65. As a result, the head frame 12 and the printhead 7 supported thereby descend together.

Second Sensor

Figure 8A:
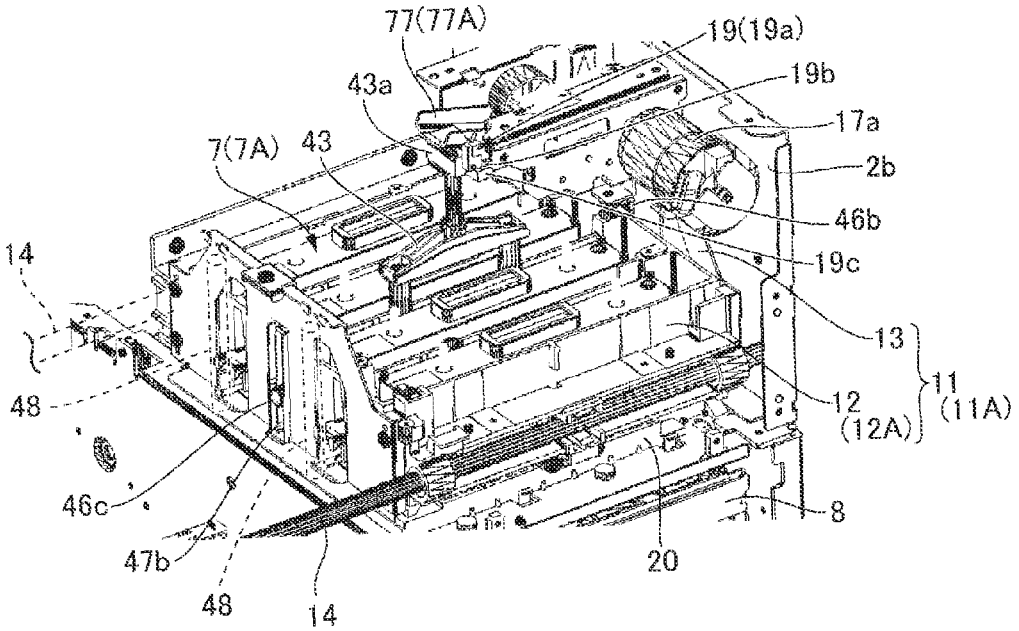
FIG. 8 illustrates a second sensor for detecting the head frame.
Figure 8B:
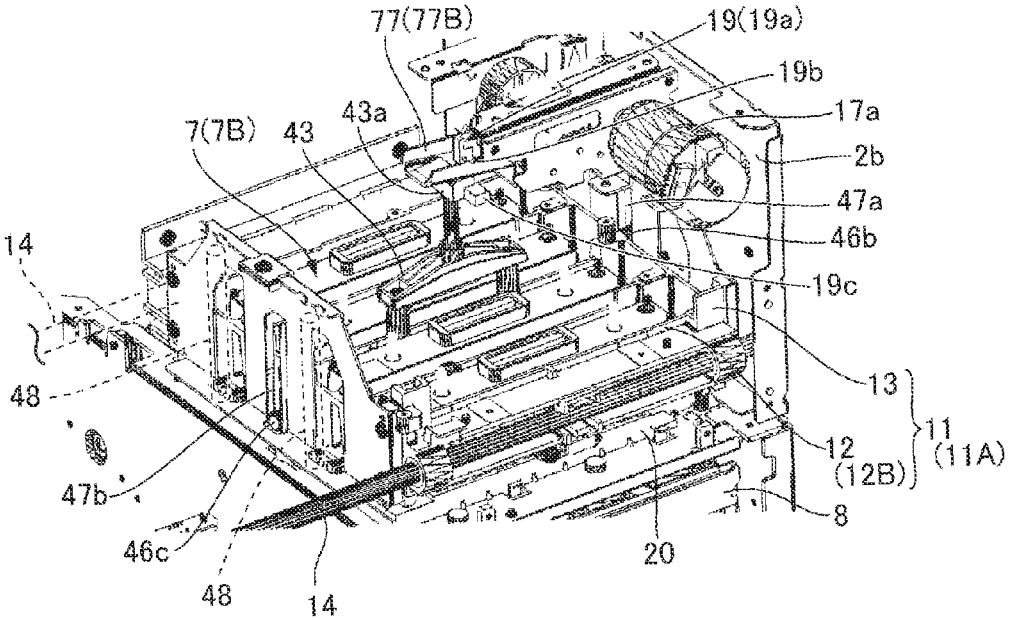

FIG. 8 illustrates the second sensor that detects the head frame 12, FIG. 8 (*a*) showing when the head frame 12 is detected, and FIG. 8 (*b*) showing when the head frame 12 is not detected.

As shown in FIG. 7 and FIG. 8, a second sensor 19 that detects the head frame 12 at the up position 12A is disposed near the distal end of the frame 76 of the head moving mechanism 17. This second sensor 19 is a mechanical sensor, and has a sensor body 19*a* attached to the frame 76, and a moving part 19*b* that protrudes below the sensor body 19*a*, that is, to the platen surface 8*a* side. As described below, the second sensor 19 is disposed at the position where operation changes between movement of the carriage 11 on the transverse axis X by the carriage moving mechanism 15, and movement of the head frame 12 and printhead 7 on the vertical axis Z by the head moving mechanism 17. As a result, in addition to being able to detect the head frame 12 at the up position 12A, and the printhead 7 at the first head position 7A (second detection position), the carriage 11 can also be detected at the opposing position 11A.

As described above, the head frame 12 has a pressure portion 19*c* protruding to the front Y1 of the stop 43*a*. The pressure portion 19*c* is disposed to a position aligned with the moving part 19*b* on the vertical axis Z when the carriage 11 is at the opposing position 11A.

As shown in FIG. 8 (*a*), when the operating lever 77 is at the lever-up position 77A, the head frame 12 is at the up position 12A, and the moving part 19*b* is pushed up by the pressure portion 19*c*.

As shown in FIG. 8 (*b*), when the operating lever 77 is at the lever-down position 77B, the head frame 12 is pushed down to the down position 12B, and the pressure portion 19*c* therefore moves down and separates from the moving part 19*b*. As a result, the moving part 19*b* returns to the position projecting down. By means of this mechanism, the second sensor 19 can detect the head frame 12 at the up position 12A, and through the head frame 12 detects the printhead 7 at the first head position 7A.

Control System

Figure 9:
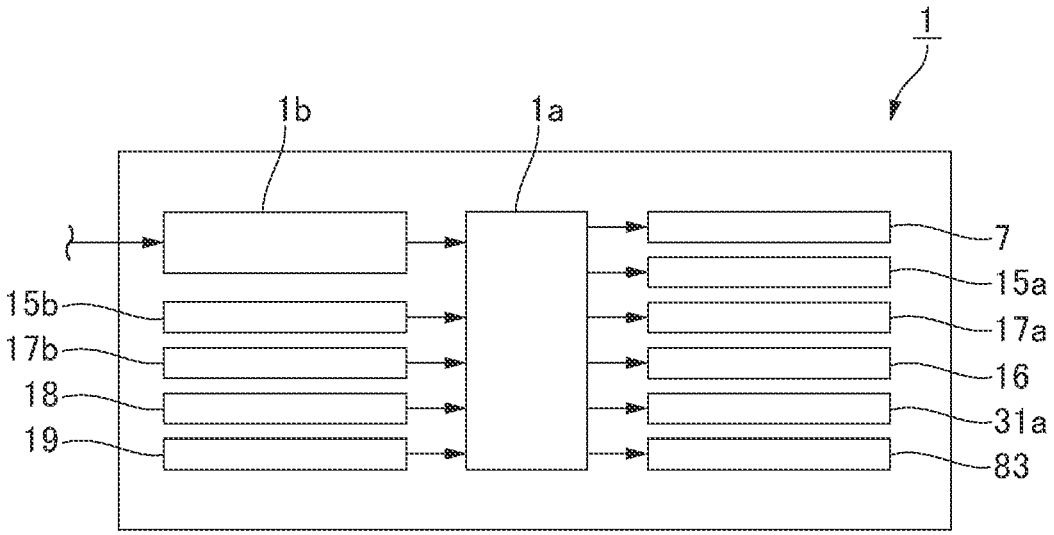
FIG. 9 is a block diagram illustrating the control system of the printer 1.

FIG. 9 is a block diagram illustrating the control system of the printer 1. The control system of the printer 1 is built around a control unit 1*a* including a CPU. Connected to the input side of the control unit 1*a* are a communication unit 1*b* that communicatively connects a computer or other external device to the printer 1; the encoder 15*b* of the carriage moving mechanism 15; the encoder 17*b* of the head moving mechanism 17; the first sensor 18 and second sensor 19; an encoder (not shown in the figure) that detects movement of the belt of the belt conveyor mechanism 80; a paper detector (not shown in the figure) that detects the recording paper P at a paper detection position on the conveyance path 10; and an encoder (not shown in the figure) that detects the rotational angle of the tension lever 32. Connected to the output side of the control unit 1*a* are the printhead 7, carriage motor 15*a*, head maintenance unit 16, media supply motor 31*a*, cam drive motor 17*a*, and conveyor motor 83.

As shown in FIG. 2, the recording paper P is pulled from the paper roll 9 loaded in the roll paper compartment 6 to the first conveyance path section 10*a* of the conveyance path 10. The recording paper P then wraps around the tension lever 32, and the leader is set passing through the second conveyance path section 10*b* and third conveyance path section 10*c*.

When print data is input to the communication unit 1*b*, the control unit 1*a* controls driving the media supply motor 31*a* to turn the roll spindle 31 and feed the recording paper P from the paper roll 9. The leading end of the recording paper P is then indexed to the print position of the printhead 7 by the conveyance operation of the belt conveyor mechanism 80. The control unit 1*a* also controls driving the carriage moving mechanism 15 and head moving mechanism 17 to position the printhead 7 opposite the platen surface 8*a* at a position maintaining the platen gap G enabling printing. The belt conveyor mechanism 80 then continues the conveyance operation continuously conveying the recording paper P at a constant speed forward from the print position to the paper exit 4. The control unit 1*a* also controls driving the printhead 7 synchronized to this conveyance operation to print on the front of the recording paper P. When printing ends, the control unit 1*a* again controls driving the carriage moving mechanism 15 and head moving mechanism 17 to set the printhead 7 opposite the head maintenance unit 16, cap the nozzle face 7*a*, and enter the standby mode.

Printer and Carriage Operation

Figure 10A:
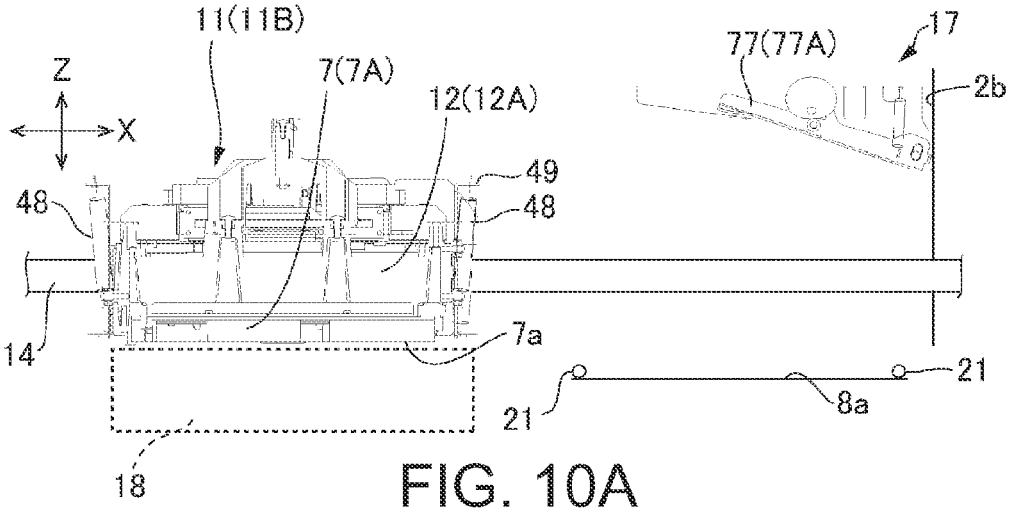
FIG. 10 illustrates operation of the printhead and carriage.
Figure 10B:
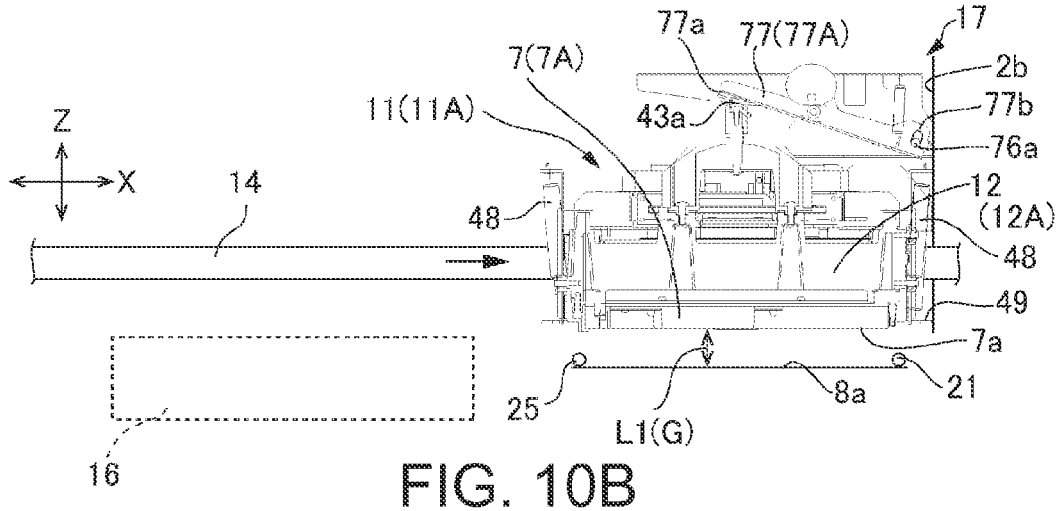
Figure 10C:
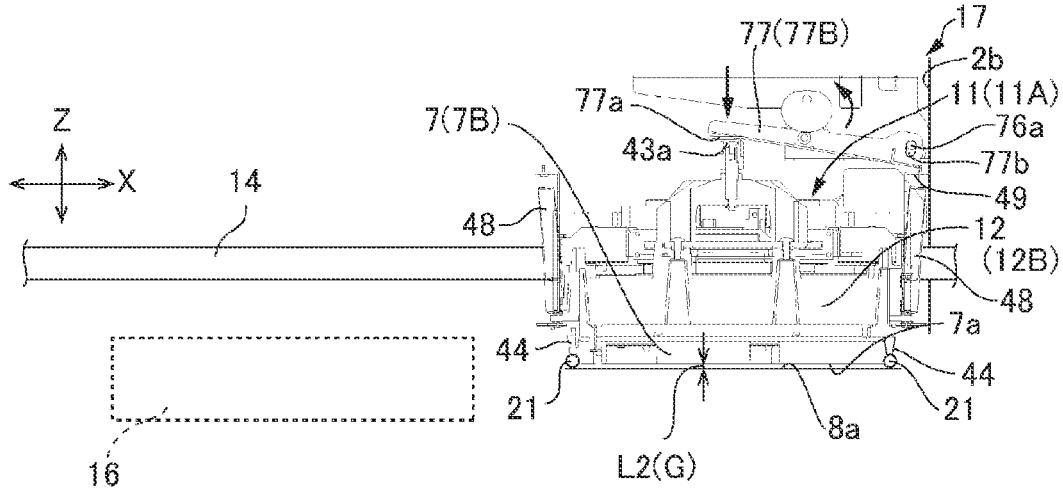

FIG. 10 illustrates the operation of the printhead 7 and carriage 11. Note that the platen top unit 20 and the platen unit 8 are not shown in FIG. 10, which shows only the positions of the bearings 21 held by the platen top unit 20 and the platen surface 8*a*.

As shown in FIG. 10 (*a*), when the printer 1 is in the standby mode, the carriage 11 is at the standby position 11B. At this time, the printhead 7 is retracted from above the platen unit 8 and is opposite the head maintenance unit 16. The head frame 12 carrying the printhead 7 is also raised to the up position 12A by the urging force of the coil springs 48. When the printer 1 is in the standby mode for an extended time, the head cap of the head maintenance unit 16 rises and caps the nozzle face 7*a* of the printhead 7.

When print data is supplied to the printer 1, the control unit 1*a* of the printer 1 drives the carriage motor 15*a*. As a result, the carriage 11 is moved from the standby position 11B along the carriage guide rails 14 above the platen unit 8, and moves to the opposing position 11A shown in FIG. 10 (*b*). While the carriage 11 is being moved by the carriage moving mechanism 15, the head frame 12 is at the up position 12A and the printhead 7 is at the first head position 7A. The printhead 7 can therefore move on the transverse axis X while the platen gap G to the platen unit 8 is held at a first distance L1 that is greater than the thickness of the platen top unit 20.

When the carriage 11 reaches the opposing position 11A, the nozzle face 7*a* of the printhead 7 is opposite the platen surface 8*a* as shown in FIG. 10 (*b*). The stop 43*a* of the head frame 12 is positioned below the operating part 77*a* of the operating lever 77 of the head moving mechanism 17 at the lever-up position 77A. Because the operating lever 77 rotates down when the cam drive motor 17*a* is driven from this position, the operating part 77*a* pushes the head frame 12 down through the intervening stop 43*a*. As a result, the head frame 12 descends from the up position 12A in resistance to the urging force of the coil springs 48, and approaches the platen surface 8*a*. When the operating lever 77 moves to the lever-down position 77B, the head frame 12 is set to the down position 12B as shown in FIG. 10 (*c*). At this time, the three bearings 21 held on the platen top unit 20 contact both the head frame 12 and the platen unit 8.

As a result, the platen gap G between the printhead 7 and platen unit 8 is a constant second distance L2, which is shorter than the diameter of the bearings 21.

Printing by the printhead 7 is possible when the platen gap G is second distance L2.

Therefore, the control unit of the printer 1 controls the conveyance operation conveying the recording paper P at a constant speed, and a printing operation that drives the printhead 7 to print, and prints the print data on the face of the recording paper P.

When printing the print data ends, the printhead 7 is returned to the position opposite the head maintenance unit 16. More specifically, the cam drive motor 17*a* is driven in reverse, and the operating lever 77 is returned from the down position 12B to the lever-up position 77A. The head frame 12 rises due to the urging force of the coil springs 48 while the operating lever 77 rises to the lever-up position 77A, and returns to the up position 12A as shown in FIG. 10 (*b*). The carriage motor 15*a* is then driven in reverse, and the carriage 11 returns from the opposing position 11A to the standby position 11B as shown in FIG. 10 (*a*).

Positioning Control of the Printhead 7 and Carriage 11 Using Sensors

Figure 11:
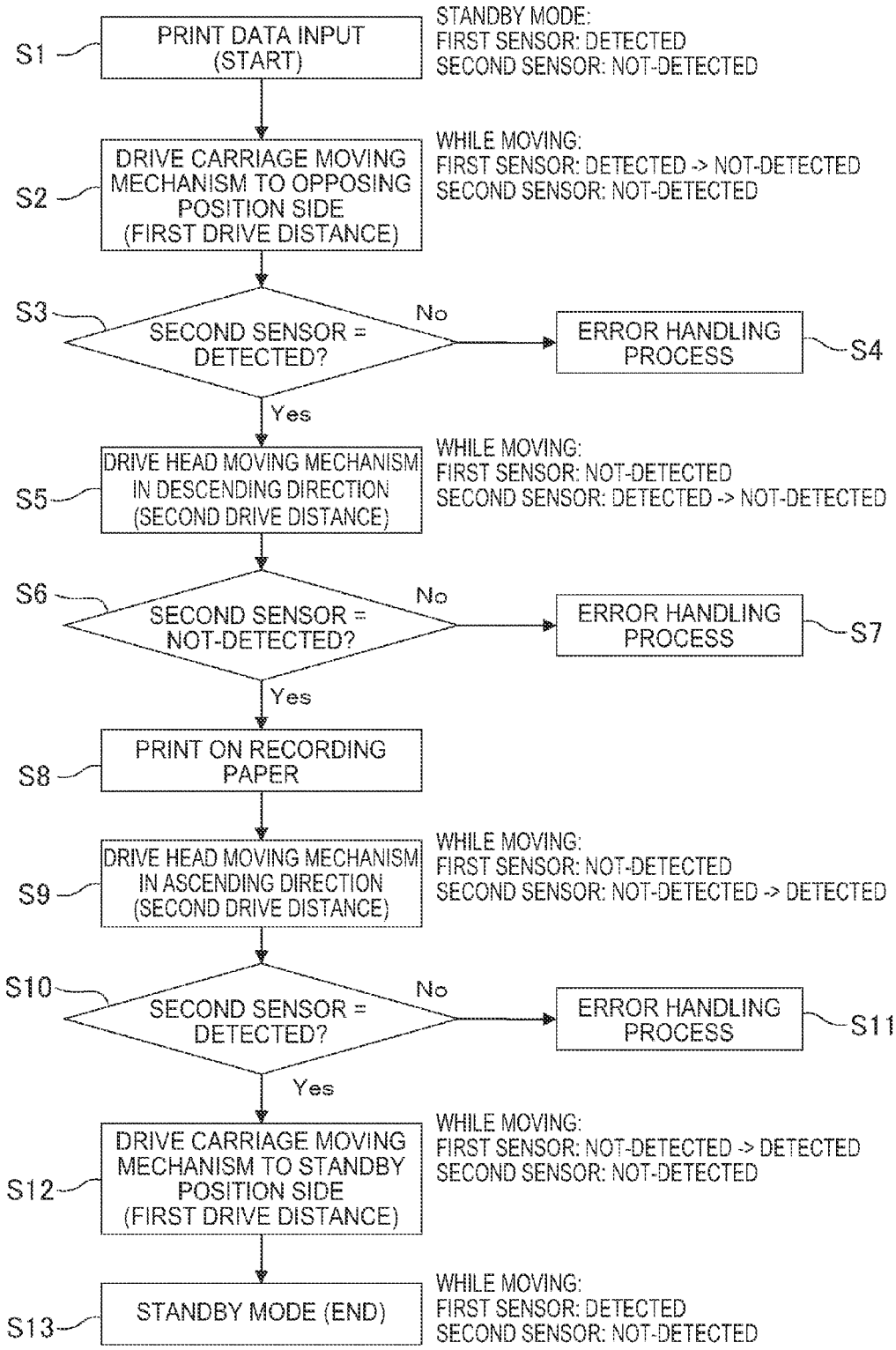
FIG. 11 is a flow chart of the process controlling the position of the printhead and carriage.

FIG. 11 is a flow chart of the process controlling the positions of the printhead 7 and carriage 11, and describes the operation illustrated in FIG. 10 (*a*) to (*c*).

The control unit 1*a* of the printer 1 controls the positions of the printhead 7 and the carriage 11 based on the signals from the first sensor 18 and the encoder 15*b*, and the signals from the second sensor 19 and the encoder 17*b*.

When print data is supplied to the printer 1 in the standby mode (step S1), the first sensor 18 is in the Detected state (more specifically, the receptor 18*b* is not receiving the detection beam) because the carriage 11 is in the standby position 11B. The position of the carriage 11 can therefore be determined at this time based on the signal from the first sensor 18.

When driving the carriage motor 15*a* starts from this position, the control unit 1*a* sets the direction of rotation of the carriage motor 15*a* to the direction of rotation moving the carriage 11 to the opposing position 11A side. The control unit 1*a* then drives the carriage motor 15*a* a preset first drive distance (step S2). The drive distance of the carriage motor 15*a* is calculated based on the signals from the encoder 15*b*. The first drive distance is the angle of rotation corresponding to the distance the carriage 11 moves when moving from the standby position 11B to the opposing position 11A. When the carriage 11 starts moving to the opposing position 11A side, the signal from the first sensor 18 goes from the Detected state to the Not-Detected state.

When a stepper motor is used as the carriage motor 15*a*, the control unit 1*a* can detect loss of synchronization in step S2 from the drive pulse signal supplied to the carriage motor 15*a* and the pulse signal from the encoder 15*b*, and can detect when the carriage 11 is not moving as expected according to the drive pulse signal. For example, if the signal from the encoder 15*b* stops changing before the carriage motor 15*a* has driven less than the first drive distance even though the drive pulse signal is applied, an error handling process can be initiated because the carriage 11 is prevented from moving to the opposing position 11A by a paper jam or other problem.

When the carriage 11 reaches the opposing position 11A, the head frame 12 is at the up position 12A. As a result, if the carriage 11 reaches the opposing position 11A, the moving part 19*b* of the second sensor 19 is pushed up by the pressure portion 19*c* of the head frame 12, and the second sensor 19 changes to the Detected state. If the signal from the second sensor 19 does not change to the Detected state (step S3 returns NO) even though the carriage motor 15*a* has been driven the first drive distance, the control unit 1*a* determines a problem has occurred and executes an error handling process (step S4).

However, if the signal from the second sensor 19 changes to the Detected state when the carriage motor 15*a* has been driven the first drive distance (step S3 returns YES), the control unit 1*a* ends operation of the carriage 11 and controls the head moving mechanism 17 to lower the head frame 12 and printhead 7. Because the signal from the second sensor 19 indicates Detected at this time, the position of the carriage 11 on the transverse axis X is identified, and the positions of the head frame 12 and printhead 7 on the vertical axis Z are identified, by the second sensor 19.

If driving the cam drive motor 17*a* starts from this position, the control unit 1*a* sets the direction of rotation of the cam drive motor 17*a* to the direction of rotation moving the head frame 12 and the printhead 7 to the platen unit 8 side, that is, the direction moving the operating lever 77 to the lever-down position 77B side. The control unit 1*a* drives the cam drive motor 17*a* a preset second drive distance (step S5). The amount the cam drive motor 17*a* is driven is calculated based on signals from the encoder 17*b*. The second drive distance is the angle of rotation corresponding to the distance the head frame 12 moves when moving from the up position 12A to the down position 12B. When the head frame 12 and printhead 7 start descending, the signal from the second sensor 19 goes from the Detected state to the Not-Detected state.

When a stepper motor is used as the cam drive motor 17*a*, the control unit 1*a* can detect loss of synchronization from the drive pulse signal supplied to the cam drive motor 17*a* and the pulse signal from the encoder 17*b*. The control unit 1*a* can therefore detect when the head frame 12 and printhead 7 are not moving as expected according to the drive pulse signal. For example, if the signal from the encoder 17*b* stops changing before the cam drive motor 17*a* has been driven the second drive distance even though the drive pulse signal is applied, an error handling process can be initiated because the head frame 12 is prevented from moving to the platen unit 8 side (the down position 12B side) by a paper jam or other problem.

If the signal from the second sensor 19 does not change to the Not-Detected state (step S6 returns NO) even though the cam drive motor 17*a* has been driven the second drive distance, the control unit 1*a* determines a problem has occurred and executes an error handling process (step S7). If the signal from the second sensor 19 changes to the Not-Detected state, loss of synchronization is not detected, and the cam drive motor 17*a* is driven the second drive distance, the control unit 1*a* stops operation of the head moving mechanism 17 and controls printing on the recording paper P (step S8).

When printing ends and the standby mode is resumed, the first sensor 18 and the second sensor 19 both output the Not-Detected signal. The control unit 1*a* then controls the head moving mechanism 17 to raise the head frame 12 and printhead 7 from the position (step S9). More specifically, the control unit 1*a* drives the cam drive motor 17*a* to turn the second drive distance in the opposite direction as the direction of rotation when lowering the head frame 12 and printhead 7. If the cam drive motor 17*a* is driven the second drive distance but the signal from the second sensor 19 does not change to the Detected state (step S10 returns NO), the control unit 1*a* determines a problem occurred and executes an error handling process (step S11).

However, if the cam drive motor 17*a* drives the second drive distance and the signal from the second sensor 19 changes to the Detected state (step S10 returns YES), the control unit 1*a* ends the lifting operation of the head frame 12 and printhead 7, and changes to moving the carriage by the carriage moving mechanism 15. At this time, because the signal from the second sensor 19 is in the Detected state, the positions of the head frame 12 and the printhead 7 on the vertical axis Z, and the position of the carriage 11 on the transverse axis X, are determined by the second sensor 19. The control unit 1*a* then drives the carriage motor 15*a* the first drive distance in the opposite direction of rotation as when moving to the opposing position 11A side (step S12). When the carriage 11 returns to the standby position 11B, the first sensor 18 signal changes to Detected. The control unit 1*a* then goes to the standby mode after the position of the carriage 11 is determined (step S13).

Recovery Process from an Unknown State

As described above, it is possible in this printer 1 for both the first sensor 18 and second sensor 19 to be in a Not-Detected state, and the position of the carriage 11 on the transverse axis X, and the positions of the head frame 12 an d7 on the vertical axis Z, to be unknown. Referred to below as an unknown state, this can occur, for example, in steps S2, S5, S9, and S12 in the flow chart shown in FIG. 11. If printer 1 operation stops in this event because a problem occurred and the encoder signals are reset, the current position of the carriage 11 and printhead 7 will be unknown when operation resumes. To determine the position of the printhead 7 on the transverse axis X and the vertical axis Z without damaging the printhead 7 when such an unknown state occurs, the control unit 1*a* executes the recovery process described below.

Figure 12:
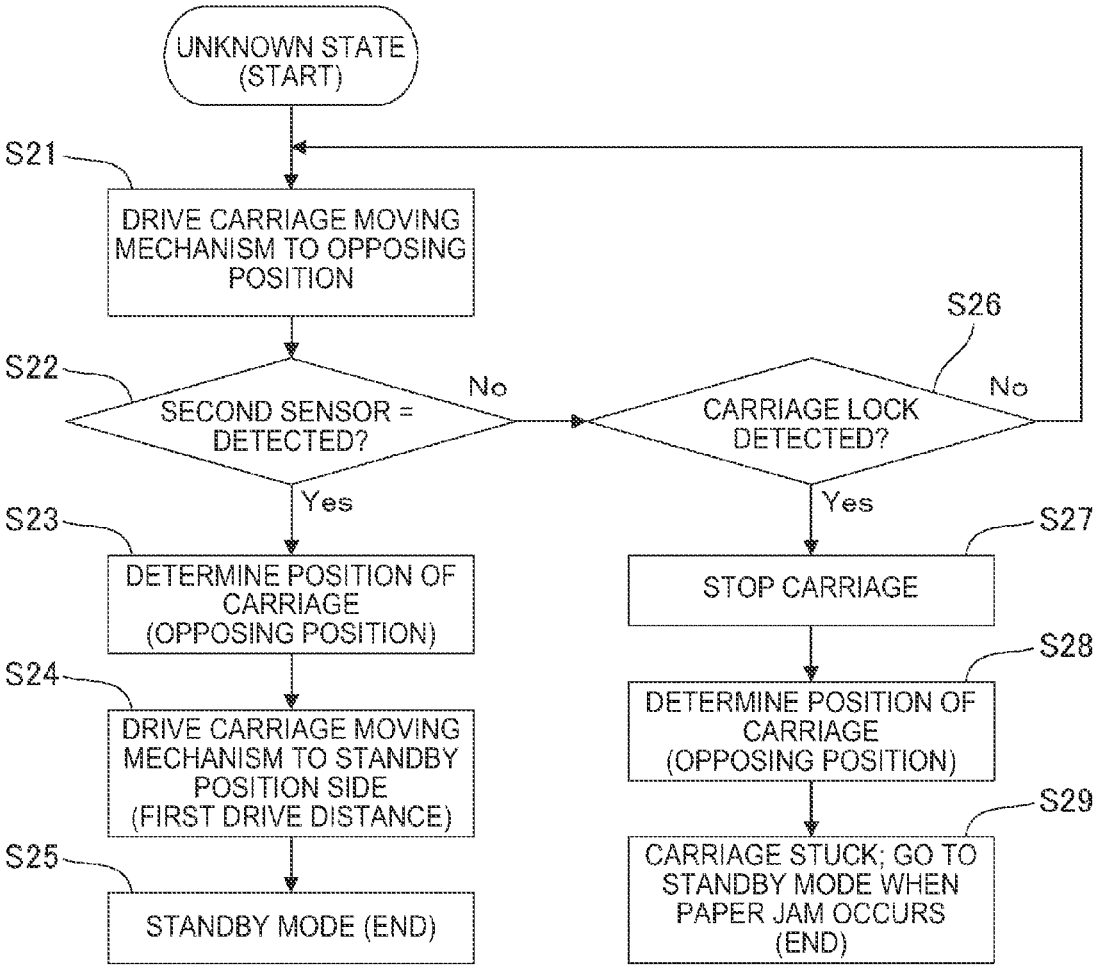
FIG. 12 is a flow chart of the recovery process from an unknown state.

FIG. 12 is a flow chart of the process of recovering from an unknown state. When in the unknown state, the control unit 1*a* drives the carriage moving mechanism 15 to the opposing position 11A side (step S21). The control unit 1*a* then reads the detection signal from the second sensor 19 (step S22). If the second sensor 19 signal indicates Detected (step S22 returns YES), the position of the carriage 11 is determined to be at the opposing position 11A (step S23). The control unit 1*a* then drives the carriage motor 15*a* the first drive distance to the standby position 11B side, returns the carriage 11 to the standby position 11B (step S24), and then goes to the standby mode (step S25).

When the carriage moving mechanism 15 is driven to the opposing position 11A side and the Detected signal from the second sensor 19 is not detected (step S22 returns NO), the control unit 1*a* checks for loss of synchronization of the carriage moving mechanism 15 based on the encoder 15*b* signal and checks if the carriage is locked (step S26). As shown in FIG. 4 and FIG. 10, a side frame 2*b* that supports the internal mechanism of the printer 1 is disposed on the outside side of the opposing position 11A on the transverse axis X. When the carriage 11 is at the opposing position 11A, the side frame 2*b* contacts the side wall portion 49 of the carriage frame 13 where the second guide channel 47*b* is formed (see FIG. 4). More specifically, the side frame 2*b* is a position limiting member that limits movement of the carriage 11 at the opposing position 11A. Therefore, if the signal from the second sensor 19 does not change to Detected and movement of the carriage 11 toward the opposing position 11A continues, the carriage 11 becomes locked against the side frame 2*b*.

If this locked state is detected without the second sensor 19 signal going to the Detected state (step S26 returns YES), the control unit 1*a* stops the carriage 11 (step S27). The control unit 1*a* also determines the carriage 11 is at the opposing position 11A (step S28). As a result, the unknown state is resolved. Based on detecting the locked state, the control unit 1*a* also determines the carriage 11 is stuck and sets the printer 1 to the standby mode assumed when a paper jam error occurs (step S29). A paper jam error is an error that requires correction by the user. However, if the second sensor 19 outputs the Detected signal but a locked state is not detected (step S26 returns NO), control returns to step S21.

If in this embodiment the carriage 11 is moved in an unknown state to the standby position 11B instead of the opposing position 11A and the head frame 12 is not at the up position 12A, the printhead 7 may interfere with the platen top unit 20 and get damaged. When moving to the opposing position 11A side, interference between the printhead 7 and the platen top unit 20 will not occur whether the head frame 12 is in the up position 12A or the down position 12B. The unknown state can therefore be resolved without damage to the printhead 7 or soiling with ink resulting from contact with the printhead 7, for example.

MAIN EFFECT OF THE INVENTION

As described above, a printer 1 according to this embodiment has a head moving mechanism 17 and a carriage moving mechanism 15 that move the printhead in two directions (the direction increasing or decreasing the platen gap G, and the direction between a position opposite and a position not opposite the platen unit 8), and has a first sensor 18 and a second sensor 19 disposed to detect the printhead 7 or the carriage 11 at reference detection positions (the standby position 11B and the first head position 7A) in each of the two directions.

By thus disposing a sensor in each direction of movement, the current position can be determined based on the amount of movement from the detection position. Therefore, when moving and controlling the position of the printhead 7 in the two directions, there is no need to provide an encoder or other sensor on the head unit to detect the position of the printhead 7 throughout the full range of movement. Increasing the size and complicating the construction of the head unit can therefore be avoided, and increased cost can be avoided.

The detection position of at least one of the first sensor 18 and second sensor 19 is also set to the position of change between movement by the head moving mechanism 17 and movement by the carriage moving mechanism 15. The detection position of the second sensor 19 is set this way in the printer 1 according to this embodiment, but the detection position of the first sensor 18 may be set in the same way. When thus comprised, the printhead 7 or the carriage 11 can always be detected at the position where the direction of movement changes. Therefore, while using a simple sensor, an inappropriate recovery operation based on the sensor output signals can be prevented when the positions of the printhead 7 and the carriage 11 are unclear (unknown) due to an error. More specifically, because the printhead 7 moves in this embodiment when the carriage 11 is at the opposing position 11A, operation of the head moving mechanism 17 can be determined to be inappropriate when the printhead 7 or the carriage 11 is not detected. Furthermore, when the printhead 7 is not detected, damage to the printhead 7 or soiling with ink may occur depending on the direction the carriage 11 moves. Therefore, by moving the carriage 11 in the appropriate direction, the printhead 7 can be recovered from the unknown state without damage to the printhead 7 or soiling with ink.

Furthermore, the first sensor 18 is an optical sensor and the second sensor 19 is a mechanical sensor in this embodiment of the invention, but the size of the head unit is not increased because such sensors are small and simple. Problems resulting from using a large head unit can also be avoided. Installation in limited space is therefore simple, and cost is low.

The head moving mechanism 17 and carriage moving mechanism 15 each comprise a motor as the drive source and an encoder, and can therefore detect if the printhead 7 or the carriage 11 is locked (a state in which the printhead 7 or carriage 11 does not move even though the motor is driven). More specifically, a locked state can be detected by detecting a loss of synchronization between the signals that drive the motors and the signals from the encoders. This locked state occurs when the printhead 7 or the carriage 11 reaches a position jammed against another member in the printer.

The current position of the printhead 7 or carriage 11 can therefore be determined by detecting a locked state. The locked state can therefore be resolved. An error can also be detected based on a loss of synchronization between the signals output from the first sensor 18 or second sensor 19 and the amount the respective motor is driven. Inappropriate operations can therefore be avoided and unknown states can be resolved.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead;

a platen;

a carriage that supports the printhead;

a carriage moving mechanism configured to move the carriage in a first direction between an opposing position and a standby position, the opposing position being where the printhead is opposite the platen, and the standby position being where the printhead is not opposite the platen;

a head moving mechanism configured to move the printhead in a second direction between a first head position and a second head position when the carriage is at the opposing position, the second direction crossing the first direction, the first head position being where a gap between the printhead and the platen is a first distance, and the second head position being where a gap between the printhead and the platen is a second distance that is shorter than the first distance;

a second sensor configured to detect the printhead and disposed at a position at which movement of the printhead by the head moving mechanism is changed to movement of the carriage by the carriage moving mechanism;

a first sensor disposed to a first detection position in a range where the carriage moving mechanism moves the carriage, and configured to detect the carriage; and a control unit configured to control movement of the printhead and the carriage based on a signal of the first sensor and a signal of the second sensor;

wherein the second sensor is disposed to a second detection position in a range where the head moving mechanism moves the printhead, and configured to detect the printhead, the first detection position and the second detection position are different;

the first detection position is the standby position;

the second detection position is the first head position; and the control unit is configured to change movement of the carriage by the carriage moving mechanism and movement of the printhead by the head moving mechanism, when the printhead is at the second detection position and the carriage is at the opposing position.

2. The printer described in claim 1, wherein:

the first sensor is an optical sensor.

3. The printer described in claim 1, wherein:

the second sensor is a mechanical sensor.

4. The printer described in claim 1, wherein:

the carriage moving mechanism includes a carriage motor and a first encoder that detects rotation of the carriage motor.

5. The printer described in claim 1, wherein:

the head moving mechanism includes a head moving motor and a second encoder that detects rotation of the head moving motor.

6. The printer described in claim 1, wherein:

when the first sensor is in the not-detected state not detecting the carriage, and the second sensor is in the not-detected state not detecting the printhead, the control unit executes a recovery process moving the carriage to the opposing position.

7. The printer described in claim 6, further comprising:

a position limiting member that limits movement of the carriage at the opposing position;

wherein the control unit detects a locked state of the carriage due to contact with the position limiting member, and determines the position of the carriage, in the recovery process.

8. A printer comprising:

a print head;

a platen;

a carriage that supports the printhead;

a carriage moving mechanism configured to move the carriage in a first direction between an opposing position and a standby position, the opposing position being where the printhead is opposite the platen, and the standby position being where the printhead is not opposite the platen;

a head moving mechanism configured to move the printhead in a second direction between a first head position and a second head position when the carriage is at the opposing position the second direction crossing the first direction the first head position being where a gap between the printhead and the platen is a first distance, and the second head position being where a gap between the printhead and the platen is a second distance that is shorter than the first distance;

a second sensor configured to detect the printhead and disposed at a position at which movement of the printhead by the head moving mechanism is changed to movement of the carriage by the carriage moving mechanism; and a first sensor disposed to a first detection position in a range where the carriage moving mechanism moves the carriage, and configured to detect the carriage;

wherein the second sensor is disposed to a second detection position in a range where the head moving mechanism moves the printhead, and configured to detect the printhead, the first detection position and the second detection position are different, the first sensor detects the carriage and is in a carriage-detected state and the carriage moving mechanism is then driven in the first direction moving the carriage toward the opposing position, and the control unit determines an error occurred if the carriage moving mechanism is driven at least a preset first drive distance but the printhead is not detected by the second sensor.

9. The printer described in claim 8, wherein:

when the second sensor detects the printhead and is in a printhead-detected state and the head moving mechanism is then driven in the second direction moving the printhead toward the second head position, the control unit determines an error occurred if the head moving mechanism is driven at least a preset second drive distance but the second sensor does not change to a not-detected state.

10. A control method of a printer having a printhead, a platen, a carriage that supports the printhead, a carriage moving mechanism that moves the carriage in a first direction, a head moving mechanism that changes a distance between the printhead and platen in a second direction perpendicular to the first direction, a second sensor that detects a position of the printhead, and a control unit that controls a position of the printhead and the carriage based on a signal from the second sensor, the second sensor being disposed at a position at which movement of the printhead by the head moving mechanism is changed to movement of the carriage by the carriage moving mechanism, the printer further having a first sensor disposed to a first detection position in a ran e where the carriage moving mechanism moves the carriage, the first sensor being configured to detect the carriage, the second sensor being disposed to a second detection position in a range where the head moving mechanism moves the carriage, the first sensor being configured to detect the printhead, the method comprising:

detecting the printhead based on a signal of the second sensor;

moving the carriage between an opposing position where the printhead is opposite to the platen, and a standby position where the printhead is not opposite to the platen;

controlling movement of the carriage based on a signal of the first sensor that detects the carriage at the standby position;

moving the printhead between a first head position and a second head position when the carriage is at the opposing position, the first head position being where a gap between the printhead and the platen is a first distance, and the second head position being where a gap between the printhead and platen is a second distance that is shorter than the first distance; and controlling movement of the printhead based on a signal f the second sensor that detects the printhead at the first head position.

11. The control method of a printer described in claim 10, the first detection position being the standby position, and the second detection position being the first head position, the control method further comprising:

changing the movement of the carriage by the carriage moving mechanism and the movement of the printhead by the head moving mechanism, when the printhead is at the second detection position and the carriage is at the opposing position.

12. The control method of a printer described in claim 10, further comprising:

when the first sensor detects the carriage and is in a carriage-detected state and the carriage moving mechanism is then driven in the direction moving the carriage toward the opposing position, determining an error occurred if the carriage moving mechanism is driven at least a preset first drive distance but the printhead is not detected by the second sensor.

13. The control method of a printer described in claim 10, further comprising:

when the second sensor detects the printhead and is in a printhead-detected state and the head moving mechanism is then driven in the direction moving the printhead toward the second head position, determining an error occurred if the head moving mechanism is driven at least a preset second drive distance but the second sensor does not change to a not-detected state.

14. The control method of a printer described in claim 10, further comprising:

when the first sensor is in a not-detected state not detecting the carriage, and the second sensor is in a not-detected state not detecting the printhead, executing a recovery process moving the carriage to the opposing position.

15. The control method of a printer described in claim 14, further comprising:

detecting a locked state of the carriage due to contact with a position limiting member that limits movement of the carriage at the opposing position; and determining the position of the carriage, in the recovery process.

* * * * *